United States Patent [19]

Sherman et al.

[11] 4,104,113

[45] Aug. 1, 1978

[54] TWO-STAGE DIGESTION WITH BETWEEN VESSEL HEATING

[75] Inventors: Michael I. Sherman; James R. Prough, both of Glens Falls, N.Y.

[73] Assignee: Kamyr, Inc., Glens Falls, N.Y.

[21] Appl. No.: 698,125

[22] Filed: Jun. 21, 1976

[51] Int. Cl.[2] ..... D21C 7/10

[52] U.S. Cl. ..... 162/19; 162/42; 162/43; 162/237; 162/246; 162/249

[58] Field of Search ..... 162/17, 19, 42, 43, 162/44, 60, 237, 246, 249

[56] References Cited

U.S. PATENT DOCUMENTS

| | | | |
|---|---|---|---|
| 2,789,051 | 4/1957 | Obenshain | 162/45 |
| 2,809,111 | 10/1957 | Durant et al. | 162/249 |
| 3,802,956 | 4/1974 | Backlund | 162/237 |
| 4,002,528 | 1/1977 | Laakso | 162/237 |

FOREIGN PATENT DOCUMENTS 2,361,627 6/1974 Fed. Rep. of Germany.

*Primary Examiner*—S. Leon Bashore
*Assistant Examiner*—William F. Smith
*Attorney, Agent, or Firm*—Cushman, Darby & Cushman

[57] ABSTRACT

An apparatus and method for the digestion of cellulosic fiber material providing pulp of very uniform quality. Cellulosic fiber material entrained in treatment liquid is fed into a top portion of a first vertical treatment vessel, impregnation of the fiber material with treatment liquid taking place in the first vessel. A first flow path of fiber material entrained in and impregnated with treatment liquid is established from the bottom of the first vessel to a top portion of a separate second vertical treatment vessel, liquid substantially filling the second vessel. Liquid is withdrawn from the top portion of the second vessel (without screening) and a second flow path is established of the liquid withdrawn from the second vessel back toward the bottom portion of the first vessel, heating of the liquid during transport in the second flow path taking place. A portion of the heated liquid flowing in the second flow path is fed into the first flow path, while the remainder of the heated liquid is fed to a bottom portion of the first vessel, the bottom portion of the first vessel serving as the heating chamber. Washing as well as digesting may taken place in the second vessel, the uniform quality digested fiber material is withdrawn from the bottom of the second vessel.

18 Claims, 2 Drawing Figures

TWO-STAGE DIGESTION WITH BETWEEN VESSEL HEATING

BACKGROUND AND SUMMARY OF THE INVENTION

The invention relates to an apparatus and method for the digestion of cellulosic fiber material (including sawdust, fines, pinchips, and other small material particles) providing the most intimate and uniform heating and mixing possible.

Two-vessel digestion of cellulosic fiber material is known, in order to facilitate uniform treatment of the pulp and for shortening digestion time after impregnation, as shown in U.S. Pat. No. 3,802,956. However, such prior two-vessel digestion has several areas thereof which may be improved upon. For instance, such prior arrangements have a mechanical separator disposed at the top of the second vessel, steam lines leading into the second vessel, and separate heating circuits for both the impregnation vessel and the digesting area of the digestion-washing vessel, and a fair amount of other equipment which can raise the costs of installation and maintenance for such a facility significantly. Intimate heating and mixing of the liquid and fiber material — while facilitated — is not ideally provided, and there are portions of the fiber material in the digestion-washing vessel which become non-uniformly treated since (depending upon the pile configuration in the vessel) they are out of the liquid, and exposed to steam at the top of the digestion-washing vessel, for a longer period of time than other adjacent portions of the fiber material column. Also, it is difficult to provide uniform heating and liquor flows in the digesting vessel when large quantities of sawdust and other fine material make up the cellulosic material being treated.

According to the apparatus and method of the present invention, the above-mentioned problems are avoided, and in general complete intimate heating and mixing are provided, resulting in pulp of very uniform quality. According to the present invention, the mechanical separator and accessory steam lines, heating circulatory loops, and other structures of the prior arrangement of U.S. Pat. No. 3,802,956 are eliminated while as good or better ultimate treatment is provided. Since the between-vessel transfer and heating lines are the same, much of such equipment in the prior arrangements may be eliminated, while providing a longer period of time in which the heated liquid and fiber material are in intimate contact with each other. Since the digestion-washing vessel is liquid-filled, no non-uniformities are introduced no matter what the pile configuration at the top of the digestion-washing vessel. Also, uniform treatment is provided despite the quantity of sawdust and other fine materials which is provided in the make-up of the fiber material being treated.

According to the present invention, a method of digesting cellulosic fiber material utilizing first and second separate vertical treatment vessels is provided, the method comprising the steps of continuously feeding cellulosic fiber material entrained in treatment liquid into a top portion of the first vessel, establishing a first flow path of cellulosic fiber material entrained in and impregnated with treatment liquid from the bottom portion of the first vessel to a top portion of the second vessel, liquid substantially filling the second vessel, establishing a column of fiber material in the second vessel below the level of liquid in the second vessel, withdrawing liquid from the top portion of the second vessel, establishing a second flow path of the liquid withdrawn from the second vessel back toward the bottom portion of the first vessel, heating the liquid during transport in the second flow path, feeding a portion of the heated liquid flowing in the second flow path into the first path while feeding the rest of the heated liquid to a bottom portion of the first vessel, and withdrawing digested fiber material from the bottom of the second vessel. The withdrawal of liquid from the top portion of the second vessel is preferably accomplished without screening, a "stilling well" being provided at the top of the second vessel above the level of fiber material in the second vessel. Washing liquid may be introduced into the second vessel to effect washing of the digested pulp therein, before withdrawal of the digested pulp from the second vessel. A third flow path may be established of treatment liquid from a lower portion of the first vessel back into the first vessel to establish countercurrent flow of liquid upwardly in the first vessel, the withdrawn liquid being heated in the third flow path. The flow of liquid in either the second or third flow path may be supplemented by fresh digesting liquid. Withdrawal of liquid from the first vessel in the third flow path also may be accomplished without screening, a "stilling well" being provided in an enlarged bottom portion of the first vessel.

According to the apparatus of the present invention, apparatus for the digestion of cellulosic fiber material is provided comprising a first vertical treatment vessel, a second vertical treatment vessel separate from the first vessel and being substantially liquid-filled, means for feeding cellulosic fiber material entrained in treatment liquid to the top portion of the first vessel, means for establishing a first flow path of cellulosic fiber material entrained in and impregnated with treatment liquid from the bottom portion of the first vessel to the top portion of the second vessel, a column of fiber material being established in the second vessel below the level of liquid in the second vessel, means for establishing the second flow path of liquid withdrawn from the top portion of the second vessel back toward the bottom of the first vessel, means for heating the liquid in the second flow path, means for feeding a portion of the heated liquid in the second flow path into the first flow path while feeding the rest of the heated liquid to the bottom portion of the first vessel (the bottom of the first vessel providing the heating chamber), and means for withdrawing digested fiber material from the bottom of the second vessel. The heating chamber provided in the bottom of the first vessel along with the relatively long first and second flow paths provide for intimate mixing and heating of the liquid and entrained fiber material before the fiber material is fed into the top of the digester-washing vessel. Since the between vessel transfer line and the heating line are one in the same, no accessory circulatory and heating loops or the like are necessary. The apparatus may also comprise means for establishing a third flow path of treatment liquid from a lower portion of the first vessel back into the first vessel to establish a countercurrent flow liquid upwardly in the first vessel, and means for heating the liquid in the third flow path. Preferably, the liquid withdrawn to the second and third flow paths is withdrawn without screening, "stilling wells" being provided at the top of the second vessel and at the top of an enlarged bottom portion of the first treatment vessel.

The primary object of the present invention is to provide a method and apparatus for effecting completely intimate and uniform heating and mixing of fiber material and digesting liquid to provide digested pulp of uniform quality. This and other objects of the invention will become apparent from an inspection of the detailed description of the invention and from an inspection of the appended claims.

DETAILED DESCRIPTION OF THE INVENTION

Figure 1:
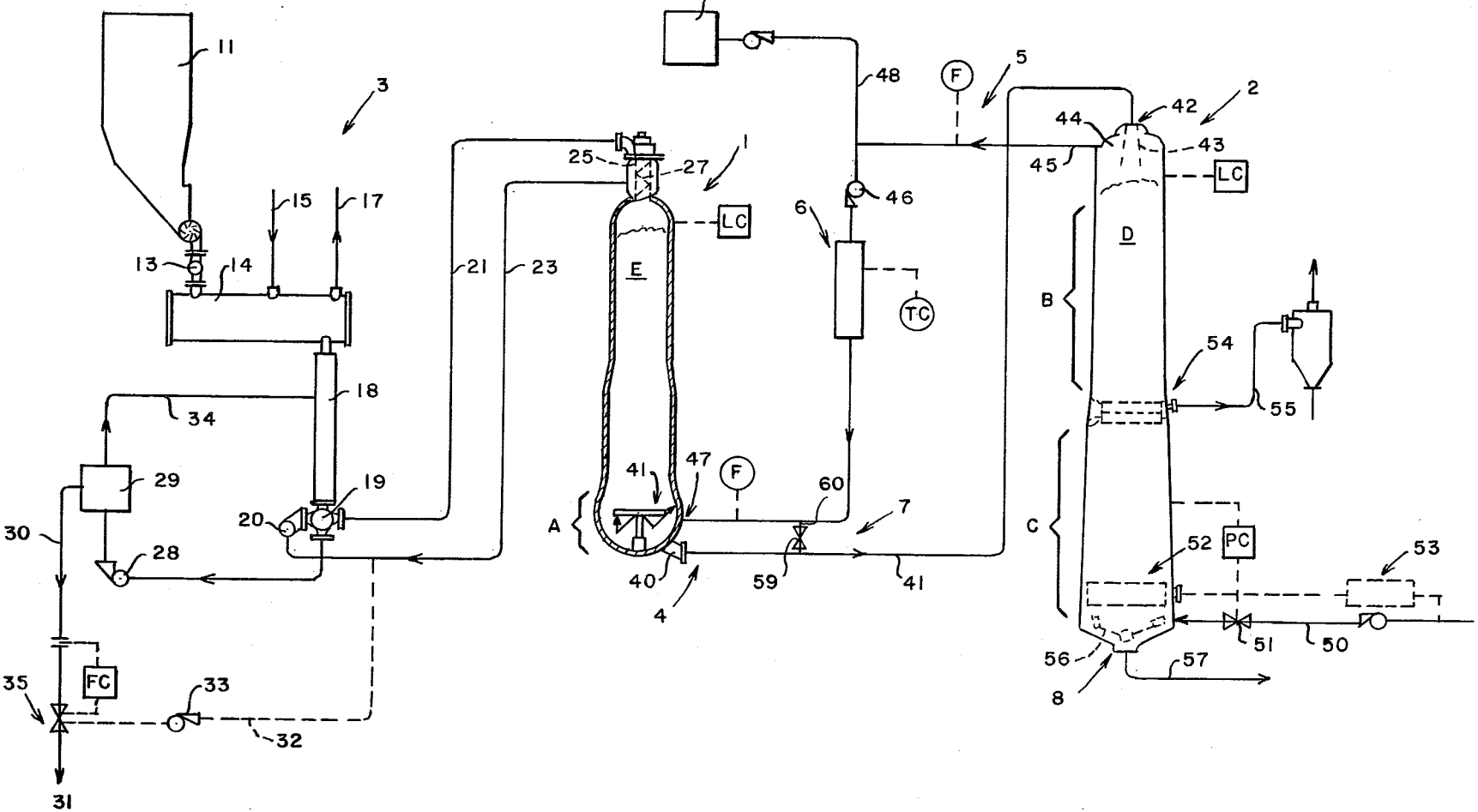
FIG. 1 is a schematic showing of exemplary apparatus according to the present invention.
Figure 2:
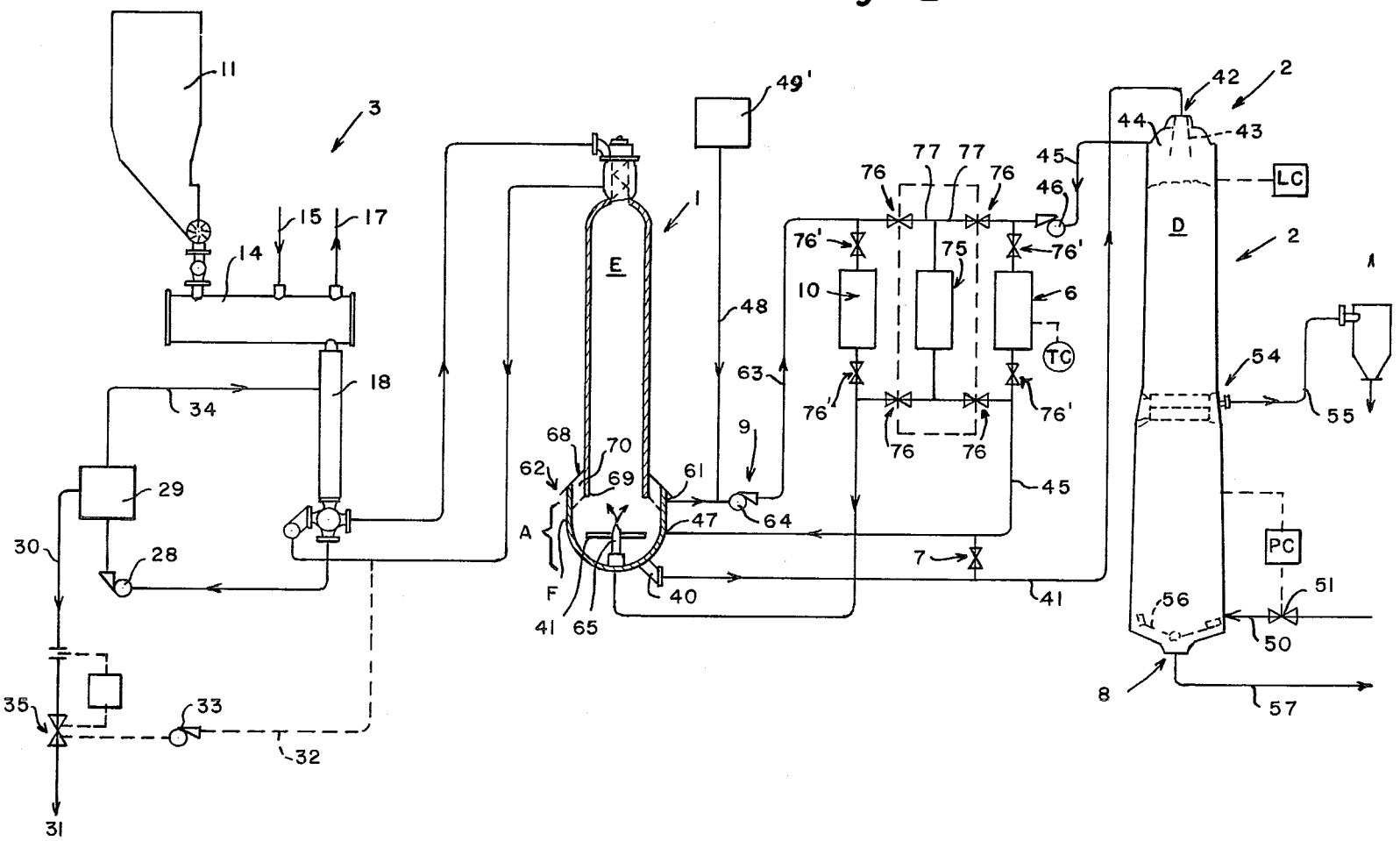
FIG. 2 is a schematic showing of a modification of the apparatus of FIG. 1.

Exemplary apparatus according to the present invention is shown schematically in FIGS. 1 and 2. The apparatus for the digestion of cellulosic fiber material generally includes a first vertical treatment vessel 1 having top and bottom portions, a second vertical treatment vessel 2 separate from said first vessel and having top and bottom portions, and being substantially liquid filled, means 3 for feeding cellulosic fiber material entrained in treatment liquid to the top portion of the first vessel 1, means 4 for establishing a first flow path of cellulosic fiber material entrained in and impregnated with treatment liquid from the bottom portion of the first vessel 1 to the top portion of the second vessel 2, a column D of fiber material being established in the second vessel 2 below the level of liquid in the second vessel 2, means 5 for establishing a second flow path of liquid withdrawn from the top portion of the second vessel 2 back toward the bottom portion of the first vessel 1, means 6 for heating the liquid in the second flow path, means 7 for feeding a portion of the heated liquid flowing from the heating means in the second flow path into the first flow path (4) while feeding the rest of the heated liquid to the bottom portion of the first vessel 1, and means 8 for withdrawing digested fiber material from the bottom of the second vessel. Optionally, as shown in FIG. 2, means 9 may be provided for establishing a third flow path of treatment liquid from a lower portion of the first vessel 1 back into the first vessel 1 to establish a countercurrent flow of liquid upwardly in the first vessel 1, and means 10 for heating the liquid in the third flow path.

The means 3 for feeding cellulosic fiber material entrained in treatment liquid to the top portion of the first vessel 1 preferably includes a chips bin 11 containing cellulosic fiber material therein (the cellulosic fiber material may be woodchips, straw, bagasse, reed, or other cellulosic plant materials), rotary low pressure valve 13, a steaming vessel 14, a conduit 15 for supplying low pressure steam (e.g., 1 atmosphere over pressure) to the vessel 14, and a conduit 17 through which air driven off during steaming may flow. From the steaming vessel 14, the cellulosic fiber material leads to a conduit 18, treatment (digesting) liquid being supplied to the fiber material in conduit 18. The fiber material then flows into conventional high pressure transfer valve 19 having a rotor with pockets therein turning in the stationary casing to provide boosting of the pressure of the flow in which the chips are entrained. Circulating liquid pressurized by the pump 20 entrains the fiber material in transfer valve 19, and the fiber material entrained in treatment liquid flows through conduit 21 to the top portion of first (impregnation) treatment vessel 1, a line 23 leading from the top of the treatment vessel 1 back to the pump 20. A strainer girdle 25 is provided in the top of the vessel 1, to provide for withdrawal of liquid from the top portion of vessel 1 and recirculation thereof through line 23. A feeding screw 27 disposed in the top portion of vessel 1 feeds the fiber material into vessel 1 to establish a fiber column E (which may be monitored by a level control). A pump 28 is disposed in the low pressure line leading from transfer valve 19 back through straining means 29 to line 34 which feeds liquid to the conduit 18. A portion of the liquid flowing in this loop is removed by the straining means 29 through conduit 30, this liquid either passing to recovery (31) or passing into line 32 under the influence of pump 33, and ultimately back into line 23. A flow control valve 35 may be provided in line 30.

Impregnation takes place in first vertical treatment vessel 1; the impregnation may take place by conventional methods, or — as shown in the drawings — displacement impregnation may be effected. Displacement impregnation is more fully discussed in commonly assigned copending application Ser. No. 719,656, filed Sept. 1, 1976 by James R. Prough and entitled "DISPLACEMENT IMPREGNATION" now U.S. Pat. No. 4,071,399. The impregnated cellulosic fiber material passes into means 4, and then ultimately to second treatment vessel 2. The means 4 for establishing a first flow path includes an outlet 40 disposed at the bottom of the vessel 1, a conventional rotating scraper 41 disposed within the vessel 1 at the bottom thereof for forcing fiber material entrained in treatment liquid into the outlet 40, a conduit 41 extending from the outlet 40 to the top of second treatment vessel 2, and means 42 at the top of the second vessel 2 for introducing the fiber material into the vessel 2 and establishing a column D in the vessel 2. The means 42 can include any suitable feeding means, however, it is preferred that it include an inverted funnel-shaped tube 43, the column of fiber material in the second vessel being established below the bottom of the tube 43, so that screenless withdrawal of treatment liquid from the top area 44 of vessel 2 above the column D may be provided. Apparatus for accomplishing such screenless liquid withdrawal is shown in more detail in U.S. patent applications Ser. Nos. 592,659, filed July 2, 1975, now U.S. Pat. No. 4,028,171; 659,638, filed Feb. 20, 1976 now U.S. Pat. No. 4,061,193 and 685,391, filed May 11, 1976, the disclosure of which is hereby incorporated by reference in the present application. It is noted that according to the present invention no feeding screw need be provided at the top of vessel 2, nor is any steaming means necessary at the top of vessel 2 as is provided in the device of U.S. Pat. No. 3,802,956. The means 5 for establishing a second flow path may include conventional screens (not shown) for withdrawing liquid therethrough at the top of the vessel 2, however, it is preferred that screenless withdrawal be provided by providing the withdrawal conduit 45 at a portion of the vessel 2 in chamber 44 above the column D of fiber in the vessel 2 (as more fully described in the above-mentioned copending applications). A pump 46 disposed in second flow path 5 provides suction for the withdrawal of liquid, and conduit 45 passes through heating means 6 to an inlet 47 at the bottom of impregnation vessel 1. Since the liquid that flows through inlet 47 into the bottom of first treatment vessel 1 is heated, a heating chamber A for heating fiber material is provided at the bottom of first vessel 1.

The bottom of the vessel 1 may be enlarged to ensure sufficiently large liquid capacity in the chamber A of vessel 1, however, an enlarged portion need not necessarily be provided at the bottom of vessel 1. The means 5 establishing a second flow path also preferably includes a source 49 of fresh treatment (digesting) liquid and a conduit 48 leading from the source 49 to the second flow path conduit 45 upstream of the pump 46 in the second flow path. (Alternatively, the source 49 and line 48 may be connected to line 32 instead of line 45 if conventional impregnation is to be effected in vessel 1 rather than displacement impregnation).

The second treatment vessel 2, which comprises a digesting and washing treatment vessel, includes a digesting zone B and a washing zone C. The digested fiber material is washed in countercurrent in the vessel 2 by means of washing liquid supplied by the conduit 50 and pumped into the lower end of the vessel 2 in a quantity controlled so as to maintain the vessel 2 filled with liquid. The amount of liquid flowing through line 50 also is controlled by pressure responsive valve 51, the position of the valve 51 being responsive to the pressure within the washing zone C. Washing liquid may be withdrawn by conventional strainer girdle 52 and indirectly heated by steam in heater 53 and then returned to the inlet line 50. Heated washing liquid is driven in countercurrent up through the slowly descending chips column in vessel 2 and displaces its contents of spent digesting liquor which departs through the conventional strainer gridle 54 and then is passed through line 55 to ultimate recovery. A conventional rotating scraper 56 is provided at the bottom of the vessel 2 which in combination with outlet line 57 forms the means 8 for withdrawing digested fiber material from the bottom of the second vessel 2. It will be seen that no heater need be provided in the digesting zone B, nor any of the other accessory structures that are usually provided therewith, and therefore, the apparatus according to the present invention is greatly simplified over prior art structures such as shown in U.S. Pat. No. 3,802,956.

The heating means 6 in second flow path 5 may include any conventional direct or indirect heating means, the temperature of the heating means 6 being controlled to provide digesting liquor of a given temperature in the first and second flow paths.

The means 7 for feeding the portion of the heated liquid flowing in the second flow path 5 into the first flow path 4 while feeding the rest of the heated liquid to the inlet 47 in the bottom of first vessel 1, preferably comprises an adjustable valve 59 disposed in a conduit 60 extending between conduits 45 and 41. The position of the valve 59 may be adjusted by manual means, or may be responsive to the flow in lines 45 and 41.

The embodiment of the invention shown in FIG. 2 is substantially the same as that in FIG. 1, except that it also includes the means 9 for establishing a third flow path of treatment liquid from a lower portion of the first vessel back into the first vessel to establish countercurrent flow of liquid upwardly in the first vessel 1, and means 10 for heating the liquid in the third flow path. The means 9 includes an outlet 61 extending from a lower portion 62 of first vessel 1, and a line 63 leading from the outlet 61 to the heating means 10, a pump 64 disposed in the line 63 upstream of the heating means 10, and an inlet 65 in the bottom of first vessel 1 for introducing treatment liquid upwardly (as shown by the arrows in FIG. 2) in first vessel 1 to flow countercurrent to the fiber material slowly flowing downwardly therein. A source 49' of fresh treatment (digesting) liquid supplies the liquid through conduit 48 to the line 63 upstream of the pump 64 instead of supplying the fresh liquid to the line 45 (as in the FIG. 1 embodiment). Preferably, screenless withdrawal of liquid from the lower portion 62 of first vessel 1 is provided at outlet 61, although conventional screening means may be utilized. When screenless withdrawal is practiced, the lower portion 62 of vessel 1 is enlarged with respect to the rest of vessel 1 (as shown in FIG. 2) and has a top portion 68 thereof disposed above the entrance 69 of the vessel 1 into the lower portion 62, so that an upper chamber 70 is provided in the lower portion 62 of vessel 1 above the level F of fiber material (shown at dotted line in portion 62 in FIG. 2) in lower portion 62. Attention is again directed to copending application Ser. Nos. 592,659, 659,638, and 685,391 wherein similar "stilling well" arrangements are disclosed.

In order to allow continuous operation of the apparatus according to the present invention while maintenance is being performed to either heating means 6 or heating means 10, an auxiliary heating means 75 is provided as well as valves 76, 76' disposed in conduit 77 leading from heaters 6 and 10 to auxiliary heater 75, and in lines 45, 63, respectively. The valve means 76 are normally closed, while valve means 76' are normally open. When it is desired to overhaul heating means 6, valve means 76' associated with heating means 6 is closed while valve means 76 associated with heating means 6 are opened, whereby liquid flowing in the second flow path bypasses heating means 6 and instead flows through auxiliary heater 75. Similarly with heating means 10.

According to the method of digesting cellulosic fiber material according to the present invention, cellulosic fiber material entrained in treatment liquid is fed into a top portion of the first vessel 1 — from chips bin 11, presteaming vessel 14, high pressure transfer valve 19, and feed screw 27 — to establish a column E of fiber material in the vessel 1. Impregnation of the fiber material takes place in the vessel 1, and a first flow path 4 is established for cellulosic fiber material entrained in and impregnated with treatment liquid from the outlet 40 in the bottom portion of the vessel 1 to top 42 of vessel 2, liquid substantially filling the second vessel 2. A column D of fiber material is established in the second vessel 2 below the level of liquid in the second vessel 2, and liquid is withdrawn from the top portion (chamber 44) of the second vessel 2. A second flow path 5 is established for the liquid withdrawn from the second vessel back toward a bottom portion of the first vessel 1, and heating of the liquid by means 6 takes place during transport of the liquid in the second flow path 5. A portion of the heated liquid flowing in second flow path 5 is fed — through valve 59 in conduit 60 — to conduit 41 of first flow path 4, while the rest of the heated liquid is fed into inlet 47 in the bottom of the first vessel 1. Digested fiber material is withdrawn through line 57 from the bottom of treatment vessel 2, and washing may take place in treatment vessel 2 (in zone C) if washing liquid is introduced through conduit 50 to flow countercourrently to the fiber material in the vessel 2. Utilizing the apparatus of FIG. 2, the method according to the present invention comprises the further step of establishing a third flow path 9 of treatment liquid from a lower portion 62 of the first vessel 1, heating the withdrawn liquid in the third flow path by utilizing heating means 10, and feeding the heated liquid thorugh inlet 65 back into the fist vessel 1 to establish a countercurrent flow of liquid upwardly in the first vessel 1. The withdrawal of liquid through outlet 61 in the first vessel and from chamber 44 of the second vessel is preferably accomplished without screening.

It will thus be seen that according to the present invention apparatus and a method have been provided which save energy compared to previous two-vessel digesting systems, eliminate the need for a mechanical separator on the top of the second vessel and the heating means in associated equipment in the digester zone of second treatment vessel 2, provides more intimate and more uniform heating and dispersion of treatment liquid in the fiber material than is possible in prior arrangements, is not dependent upon the shape of the top of the column established in the second treatment vessel, and is utilizable with sawdust, fines, pinchips, and many other forms of cellulosic fiber material that are not practically utilizable in prior art devices. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of digesting cellulosic fiber material utilizing a first vessel and a separate second vessel, said method comprising the steps of continuously (a) feeding cellulosic fiber material entrained in treatment liquid into a top portion of the first vessel, (b) establishing a first flow path of cellulosic fiber material entrained in and impregnated with treatment liquid from a bottom portion of the first vessel to a top portion of the second vessel, liquid substantially filling the second vessel, (c) establishing a column of fiber material in the second vessel below the level of liquid in the second vessel, (d) withdrawing liquid from a top portion of the second vessel, (e) establishing a second flow path of the liquid withdrawn from the second vessel back toward a bottom portion of the first vessel, (f) heating the liquid during transport in said second flow path, (g) feeding a portion of the heated liquid flowing in said second flow path into said first flow path, while feeding the rest of the heated liquid to a bottom portion of the first vessel, and (h) withdrawing digested fiber material from the bottom of the second vessel.

2. A method as recited in claim 1 comprising the further step of supplementing the flow of liquid in said second flow path, before heating thereof, with fresh treatment liquid.

3. A method as recited in claim 1 wherein said step of withdrawing liquid from a top portion of the second vessel is accomplished by withdrawing liquid from the second vessel above the fiber column established in the second vessel without screening, and wherein said step of establishing said first flow path to a top portion of the second vessel is accomplished by feeding fiber material entrained in liquid into a tube extending from the top of the second vessel into the second vessel, the fiber column being established in said second vessel just below said tube.

4. A method as recited in claim 1 comprising the further step of feeding washing liquid into a lower portion of the second vessel and washing the cellulosic fiber material before withdrawing it from the bottom portion of the second vessel.

5. A method as recited in claim 1 comprising the further steps of establishing a third flow path of treatment liquid from a lower portion of the first vessel, heating the withdrawn liquid in the third flow path, and feeding the heated liquid back into the first vessel to establish a countercurrent flow of liquid upwardly in the first vessel.

6. A method as recited in claim 5 comprising the further step of supplementing the flow of liquid in the third flow path, before heating thereof, with fresh treatment liquid.

7. A method as recited in claim 5 wherein the step of establishing a third flow path of treatment liquid from the first vessel is accomplished by providing an enlarged lower portion of the first vessel, establishing a column of fiber material in the enlarged lower portion of the first vessel by feeding the fiber material into the first vessel below the top of the enlarged portion of the first vessel, and withdrawing the liquid above the column in the enlarged lower portion of the first vessel without screening.

8. Apparatus for the digestion of cellulosic fiber material comprising (a) a first vertical treatment vessel having top and bottom portions, (b) a second vertical treatment vessel separate from said first vessel and having top and bottom portions, and being substantially liquid filled, (c) means for feeding cellulosic fiber material entrained in treatment liquid to the top portion of said first vessel, (d) means for establishing a first flow path of cellulosic fiber material entrained in and impregnated with treatment liquid from the bottom portion of said first vessel to the top portion of said second vessel, a column of fiber material being established in said second vessel below the level of liquid in said second vessel, (e) means for establishing a second flow path of liquid withdrawn from the top portion of said second vessel back toward the bottom portion of the first vessel, (f) means for heating the liquid in the second flow path, (g) means for feeding a portion of the heated liquid flowing from the heating means in the second flow path into the first flow path while feeding the rest of the heated liquid to the bottom portion of said first vessel, and (h) means for withdrawing digested fiber material from the bottom of said second vessel.

9. Apparatus as recited in claim 8 wherein said means for feeding a portion of the heated liquid flowing from the heating means in the second flow path into the first flow path while feeding the rest of the heated liquid to the bottom portion of said first vessel comprises an adjustable valve disposed in a conduit connecting the first flow path to the second flow path.

10. Apparatus as recited in claim 8 wherein said means for establishing a second flow path includes a conduit extending between the top portion of the second vessel and the bottom portion of the first vessel, and a pump disposed in said conduit upstream of said heating means in said second flow path.

11. Apparatus as recited in claim 10 further comprising a source of fresh treatment liquid and a conduit leading from the source to said second flow path upstream of said pump in said second flow path.

12. Apparatus as recited in claim 8 wherein said means for establishing said first flow path includes a rotatable scraper disposed at the bottom of said first vessel and a conduit leading from said first vessel to said second vessel.

13. Apparatus as recited in claim 8 wherein said means for establishing said first flow path includes a tube extending from the top of said second vessel into said second vessel, the column of fiber material in said second vessel being established below the bottom of said tube, and wherein said means for establishing said second flow path includes means for withdrawing liquid from above the top of the column in said second vessel without screening.

14. Apparatus as recited in claim 8 further comprising means for establishing a third flow path of treatment liquid from a lower portion of said first vessel back into said first vessel to establish a countercurrent flow of liquid upwardly in said first vessel, and means for heating the liquid in said third flow path.

15. Apparatus as recited in claim 14 wherein said first vessel has an enlarged bottom portion thereof, and wherein fiber material is fed from the first vessel into the enlarged bottom portion thereof at a point below the top of the enlarged bottom portion, and wherein said means for establishing said third flow path includes means for withdrawing liquid from said enlarged bottom portion of said first vessel above the level of fiber material in the enlarged bottom portion of said first vessel without screening.

16. Apparatus as recited in claim 14 further comprising an auxiliary heating means, conduits extending from both said heating means in said second and third flow paths to said auxiliary heating means, and valve means disposed in said conduits and in said second and third flow paths for providing closing off of the heating means in said second or third flow path and passage of the liquid in said second or third flow path through said auxiliary heating means.

17. Apparatus as recited in claim 14 further comprising a source of fresh treatment liquid and a conduit extending from said source to said third flow path, and a pump in said third flow path disposed upstream of said heating means in said third flow path, said source conduit being disposed in said third flow path upstream of said pump.

18. Apparatus as recited in claim 8 wherein said first vessel feeding means includes a steaming vessel, a high pressure transfer valve operatively connected to said steaming vessel, a conduit leading from said high-pressure transfer valve to the top of said first vessel, and a feeding screw disposed in the top of said first vessel.

* * * * *